US006913356B2

(12) United States Patent
Belly et al.

(10) Patent No.: US 6,913,356 B2
(45) Date of Patent: Jul. 5, 2005

(54) METHOD FOR FITTING A HOLDING BLOCK TO A SEMIFINISHED OPHTHALMIC LENS BLANK

(75) Inventors: Jean-François Belly, Choisy le Roi (FR); Bruno Fauquier, Champigny (FR); Eric Comte, Thorigny sur Marne (FR)

(73) Assignee: Essilor International (Compagnie Generale d'Optique, Charenton le Pont (FR)

( * ) Notice: Subject to any disclaimer, the term of this patent is extended or adjusted under 35 U.S.C. 154(b) by 38 days.

(21) Appl. No.: 10/372,179

(22) Filed: Feb. 25, 2003

(65) Prior Publication Data

US 2003/0214058 A1 Nov. 20, 2003

(30) Foreign Application Priority Data

Feb. 26, 2002 (FR) ..... 02 02409

(51) Int. Cl.[7] ..... G02C 7/02
(52) U.S. Cl. ..... 351/177; 451/398
(58) Field of Search ..... 351/177; 451/398

(56) References Cited

U.S. PATENT DOCUMENTS 4,714,232 A 12/1987 Blot ..... 249/90
5,177,907 A * 1/1993 Rothe et al. ..... 451/390
6,568,990 B2 * 5/2003 Siders et al. ..... 451/5
2004/0046960 A1 * 3/2004 Wagner et al. ..... 356/399

* cited by examiner

*Primary Examiner*—Scott J. Sugarman
*Assistant Examiner*—Darryl J. Collins
(74) *Attorney, Agent, or Firm*—Young & Thompson

(57) ABSTRACT

A method of fitting a holding block to a semifinished ophthalmic lens blank intended to have a predetermined prism, which method includes the following steps:

positioning the blank on a fixed base so that the finished face of the blank bears conjointly on a plurality of bearing points of the base, defining an orientation of the holding block, orienting the holding block in the defined manner, and fixing the holding block to the finished face, the step of defining the orientation of the holding block including the following steps:

taking account of the three-dimensional shape of the finished face and the position of the bearing points, deducing therefrom the orientation of the finished face, taking account of a predetermined prism, and deducing from the orientation of the finished face and the predetermined prism the orientation of the holding block.

21 Claims, 9 Drawing Sheets

Fig.6
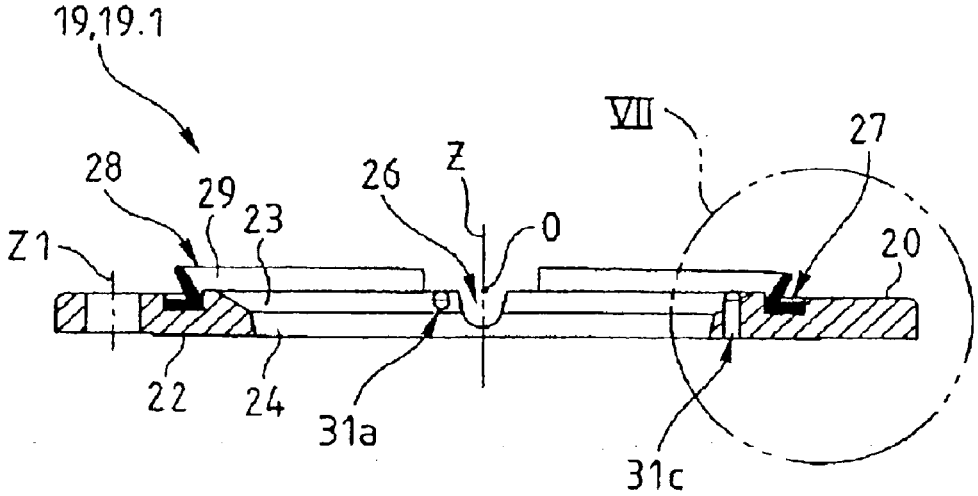
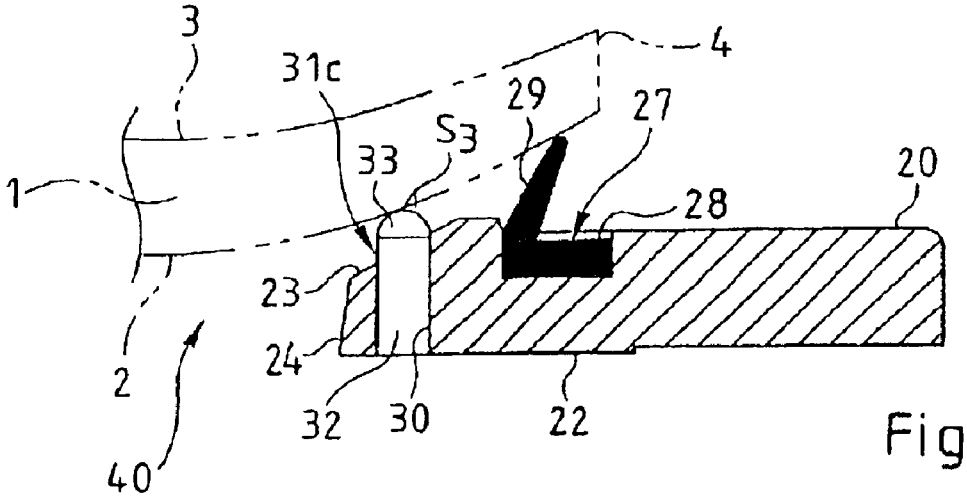
Fig.7

METHOD FOR FITTING A HOLDING BLOCK TO A SEMIFINISHED OPHTHALMIC LENS BLANK

BACKGROUND OF THE INVENTION

The invention relates to a method of fitting a holding block to a semifinished ophthalmic lens blank.

DESCRIPTION OF THE RELATED ART

In the manufacture of ophthalmic lenses, a finished lens is formed from a blank with a cylindrical edge and whose untreated faces, which are obtained by molding or by machining, are successively buffed and polished, which is known as surfacing.

The faces, of which one is generally concave and the other convex, are surfaced one after the other. For practical reasons, the convex face is generally surfaced before the concave face. A lens blank of which only one of the faces has been finished, i.e. surfaced, is called a semifinished blank.

Surfacing the second face is a more difficult operation requiring greater accuracy, as it is necessary not only to confer the required surface state and curvature on this second face, but also to orient it extremely accurately so that the finished lens has the required optical properties.

This orientation may necessitate one or two predetermined adjustments, one of which is called the prism adjustment and the other the axis adjustment.

The prism adjustment, which is generally a prescription prism measured in diopters and determined by the ophthalmologist, involves tilting the second face relative to the first, while the axis adjustment involves rotating the second face relative to the first about the optical axis of the lens.

Fitting a holding block to the semifinished blank of an ophthalmic lens intended to have a particular prism generally consists of:

- positioning the blank on a fixed base, in a centered and angularly defined manner, so that the finished face of the blank bears conjointly on a plurality of bearing points of said base,
- defining an orientation of the holding block relative to the blank,
- orienting the holding block in the defined manner, and
- fixing the holding block to the finished face while maintaining its orientation.

U.S. Pat. No. 4,714,232 in the name of the applicant describes a method of the above type.

Semifinished blanks for ophthalmic lenses are ordinarily supplied with marks on the finished face. As a general rule, a dot marks the prism reference point (PRP), through which the optical axis passes, and a line or a succession of aligned lines show a location axis for fitting the lens into an eyeglass frame.

In practice the location axis corresponds to the horizontal nose-ear axis, relative to which the ophthalmologist generally indicates the axis adjustment.

When positioning it on the base, centering the blank consists of placing the PRP on a fixed centering axis defined relative to the base, and the angular orientation of the blank consists of placing the location axis in a fixed plane defined relative to the base and containing the centering axis.

Because of the curvature of the finished face, when it is in contact with all of the bearing points and its centering and angular orientation are preserved, the blank is tilted, that is to say the optical axis of the lens is pivoted relative to the centering axis.

As a result of this, when positioning the blank on the base, an uncontrolled prism arises, which must be compensated when orienting the holding block. Finished faces with progressively varying curvatures are inherently the most likely to cause uncontrolled prism to appear and to randomize the position of the blank on the base.

One solution for precise control of positioning is to provide a different base for each type of finished face. This kind of solution is obviously extremely costly, and necessitates many handling operations, not only for selecting each of the bases from a range that is necessarily very wide, given the variety of faces with progressively varying curvature, but also for positioning the base on its support.

Furthermore, it is necessary to ensure that, regardless of the curvature of the finished face, the PRP is always located substantially on the centering axis, so that the distance of the holding block from the PRP varies little if at all from one lens to the other.

This is because, although the lens must be sufficiently far away from the holding block not to strike it, it must also be sufficiently close to it for the combination of the block and the lens to be sufficiently rigid.

As the curvature of the front face varies from one lens to another, it is usual to provide rings of different height to compensate the displacement of the PRP along the centering axis, which necessitates a large number of different rings.

Another solution, described in the U.S. Pat. No. 4,714,232 referred to above, proposes to produce a base in the form of a bearing ring having three bearing areas for contact with a semifinished blank arranged circumferentially around an axis and at the vertices of an isosceles triangle, each bearing area having a plurality of facets which conjointly form a globally convex combination.

At the time the application for the above patent was filed, this kind of arrangement was particularly advantageous compared to the prior art techniques, the same ring being usable for processing a whole range of semifinished blanks.

In fact, the bearing areas are angularly distributed so that two of them are in contact with the distant vision portion of the finished face and the third is in contact with the near vision portion.

Consequently, it is clearly necessary to classify the various finished faces with progressively varying curvature by type, as a function of their analogous topographies, in order for the same ring to suit them. It is therefore necessary to provide a number of rings equal to the number of different types of finished faces with progressively varying curvature. Thus the same ring cannot be used for the whole of the range of lenses produced.

Moreover, although this solution minimizes the risk associated with the appearance of prism during positioning of the semifinished blank, the risk is not eliminated entirely.

Be this as it may, regardless of the technique employed for the fitting to a semifinished blank for an ophthalmic lens, the final optical properties of the lens never correspond very accurately to the prescription of the ophthalmologist, although this inaccuracy is generally tolerated.

SUMMARY OF THE INVENTION

The invention aims in particular to solve the drawbacks previously cited of the techniques known in the art by proposing a solution which, by controlling the risks associated with the occurrence of positioning prism, enables ophthalmic lenses with improved optical qualities to be produced more quickly and at lower cost.

To this end, a first aspect of the invention proposes a method of fitting a holding block to a semifinished ophthalmic lens blank intended to have a predetermined prism, which method includes the following steps:

positioning the blank on a fixed base, in a centered and angularly defined manner, so that the finished face of the blank bears conjointly on a plurality of bearing points of said base, defining an orientation of the holding block relative to the blank, orienting the holding block in the defined manner, and fixing the holding block to the finished face while maintaining orientation, characterized in that the step of defining the orientation of the holding block includes the following steps:

taking account of the three-dimensional shape of the finished face and the position of said bearing points, deducing therefrom the orientation of the finished face when the blank is positioned on the base, taking account of the predetermined prism, and deducing from the orientation of the finished face and the predetermined prism the orientation of the holding block relative to the finished face.

In this way, it is possible to compensate very accurately any tilting of the blank when it is placed on the base, so that the real prism imparted to the blank when positioning the holding block actually corresponds to the predetermined prism.

For example, to orient the finished face when the blank is positioned on the base, a positioning prism resulting from tilting of the blank when it is placed on the base is calculated.

To be more precise, to define the orientation of the holding block, two angles $\gamma$ and $\phi$ can be calculated that are defined by the following equations:

$$\gamma = \text{Arccos}\left(\tan(AngV)\times\sin(AngV_0) + \frac{\cos(AngV_0)}{\sqrt{1+\tan^2(AngH)+\tan^2(AngV)}}\right)$$

$$\phi = \text{Arctan}\left(\frac{\sin(AngV - AngV_0)}{\sin(AngH)}\right)$$

in which:

AngH and AngV are defined as follows:

$$AngH = \text{Arctan}\left(\frac{\left(\frac{\partial f_N}{\partial x}\right)_{x=0,y=0}}{L}\right)$$

$$AngV = \text{Arctan}\left(\frac{\left(\frac{\partial f_N}{\partial y}\right)_{x=0,y=0}}{L}\right)$$

where $f_N$ is a function of the type $z=f_N(x,y)$ defining the shape of the finished face in a system of axes XYZ fixed relative to the base and x,y,z are the Cartesian coordinates linked respectively to the axes X, Y and Z of said fixed system of axes, L being defined by the following formula:

$$L = \sqrt{1+\left(\frac{\partial f_N}{\partial x}\right)^2_{x=0,y=0}+\left(\frac{\partial f_N}{\partial y}\right)^2_{x=0,y=0}}$$

$AngV_0$ is defined as follows:

$$AngV_0 = \frac{\text{Arctan}\left(\frac{PrV_0}{100}\right)}{n-1}$$

$PrV_0$ being defined as follows:

$$PrV_0 = K\times add$$

where add is the power addition of the ophthalmic lens to be obtained and K is an index of proportionality preferably equal to $$\frac{2}{3}.$$

Three bearing points being provided on the base, the function $f_N$ can be obtained by repeating the following succession of steps:

calculating a function $f_p$ defining the three-dimensional shape of the finished face in the fixed system of axes XYZ, calculating the depths $z_i$ tied to the axis Z of the fixed system of axes XYZ of the projections of the bearing points onto the finished face in the direction of the axis Z by means of the following formula: $Z_i=f_p(x_i,y_i)$ where, for each bearing point, $x_i$ and $y_i$ are its coordinates respectively tied to the axis X and the axis Y of the fixed system of axes XYZ, calculating the maximum difference $\epsilon$ between the depths $z_i$, comparing the difference $\epsilon$ with a predetermined value $\epsilon_0$, calculating the angles $\alpha_p$ and $\beta_p$ defined by the following equations:

$$\alpha_p = \text{Arc tan}(a)$$

$$\beta_p = \text{Arc tan}(b)$$

where a and b are the director coefficients of the plane $A_p$ passing through the projections of the bearing points onto the finished face, tilting the finished face with a first rotation through an angle $\alpha_p$ in the plane X, Z and a second rotation through an angle $\beta_p$ in the plane Y, Z, incrementing p by one unit, for as long as the difference $\epsilon$ is greater than the predetermined value $\epsilon_o$, where:

i is an integer from 1 to 3, p is an integer initially equal to 1, with $$f_1 = f$$

where $f$ is a predetermined function of the type $z'=f(x',y')$ defining the three-dimensional shape of the finished face in an orthogonal system of axes X'Y'Z' tied to the finished face, x',y',z' being the cartesian coordinates respectively tied to the axes X', Y', Z' of the tied system of axes X'Y'Z', N is the value of p when the difference $\epsilon$ becomes less than the predetermined value $\epsilon_0$.

The difference $\epsilon$ is defined as follows, for example:

$$\epsilon = \max(|z_1-z_2|, |z_1-z_3|, |z_2-z_3|).$$

Furthermore, the plane $A_p$ being defined in the fixed system of axes XYZ by the equation:

$$z=ax+by+c,$$

the coefficients a and b are defined as follows:

$$\begin{bmatrix} a \\ b \\ c \end{bmatrix} = \begin{bmatrix} x_1 & y_1 & 1 \\ x_2 & y_2 & 1 \\ x_3 & y_3 & 1 \end{bmatrix}^{-1} \begin{bmatrix} z_1 \\ z_2 \\ z_3 \end{bmatrix}$$

The holding block, which has an axis Z", is oriented so that:

the angle between its axis Z" and the axis Z of the fixed system of axes XYZ is equal to the angle $\gamma$, and the angle between the projection of its axis Z" in the plane formed by the axes X, Y of the fixed system of axes XYZ and the axis X of that fixed system of axes is equal to the angle $\phi$.

The holding block can be fixed to the finished face by pouring a low melting point metal into a cavity formed between the finished face and the holding block and cooling the metal or allowing it to cool.

In a second aspect, the invention provides blocking apparatus for fitting a holding block to a semifinished ophthalmic lens blank, which apparatus includes:

a fixed base for positioning the semifinished blank, means for centering and orienting in a defined manner the blank relative to the support, means for retaining the blank on the base, means for fixing the holding block to the finished face, means for defining the orientation of the holding block as a function of the three-dimensional shape of the finished face, and means for varying the orientation of the holding block relative to the base as a function of the defined orientation.

The means for defining the orientation of the holding block include a calculator, for example.

In a third aspect, the invention provides a bearing ring for positioning a semifinished ophthalmic lens blank on blocking apparatus for the purpose of fitting to the finished face of the blank a holding block, the ring including a plurality of bearing points against which the finished face of the blank is adapted to press, the bearing points each being on a spherical surface whose diameter is small compared to the radius of curvature of the finished face of the blank.

The diameter of said spherical surface is from 1.5 mm to 3 mm, for example, and preferably equal to 2 mm.

In one embodiment each spherical surface can be on a projecting peg, which may be add-on.

In one embodiment the ring includes three pegs.

The ring is globally circularly symmetrical about an axis Z and the summits of the pegs are in a common plane perpendicular to the axis Z, for example at the vertices of a triangle whose circumscribed circle is centered on the axis Z.

The circumscribed circle can have a diameter from 50 to 60 mm, and preferably equal to 55 mm.

In one embodiment the angles at the vertices of said triangle are respectively from 60° to 80°, from 50° to 70°, and from 40° to 60°.

The ring may furthermore have a recessed channel extending along a radial axis for casting a low-melting-point metal.

In one embodiment one of the pegs is near the channel.

For example, the peg near the channel may be offset angularly relative thereto by an angle from 5° to 15° and preferably equal to 10°.

In a variant form, one of the pegs is diametrically opposite the channel and on the axis thereof.

BRIEF DESCRIPTION OF THE DRAWINGS

Other features and advantages of the invention will become apparent in the course of the following description given by way of non-limiting example of one embodiment of the invention with reference to the accompanying drawings, in which:

FIG. 6 is a view of the ring of FIG. 5 in elevation and in section taken along the line VI—VI in that figure;

FIG. 7 is a view to a larger scale of the detail VII of the bearing ring of FIG. 6, with a semifinished ophthalmic lens blank, which is shown partly, in chain-dotted outline, placed on the ring;

A semifinished ophthalmic lens blank 1 has a convex front face 2 and a concave rear face 3 connected by a cylindrical edge 4.

The following description presupposes, as is generally the case in practice, that the front face 2 is finished, in other words that it has already been surfaced, whereas the rear face 3 is the untreated face as molded or machined.

Figure 1:
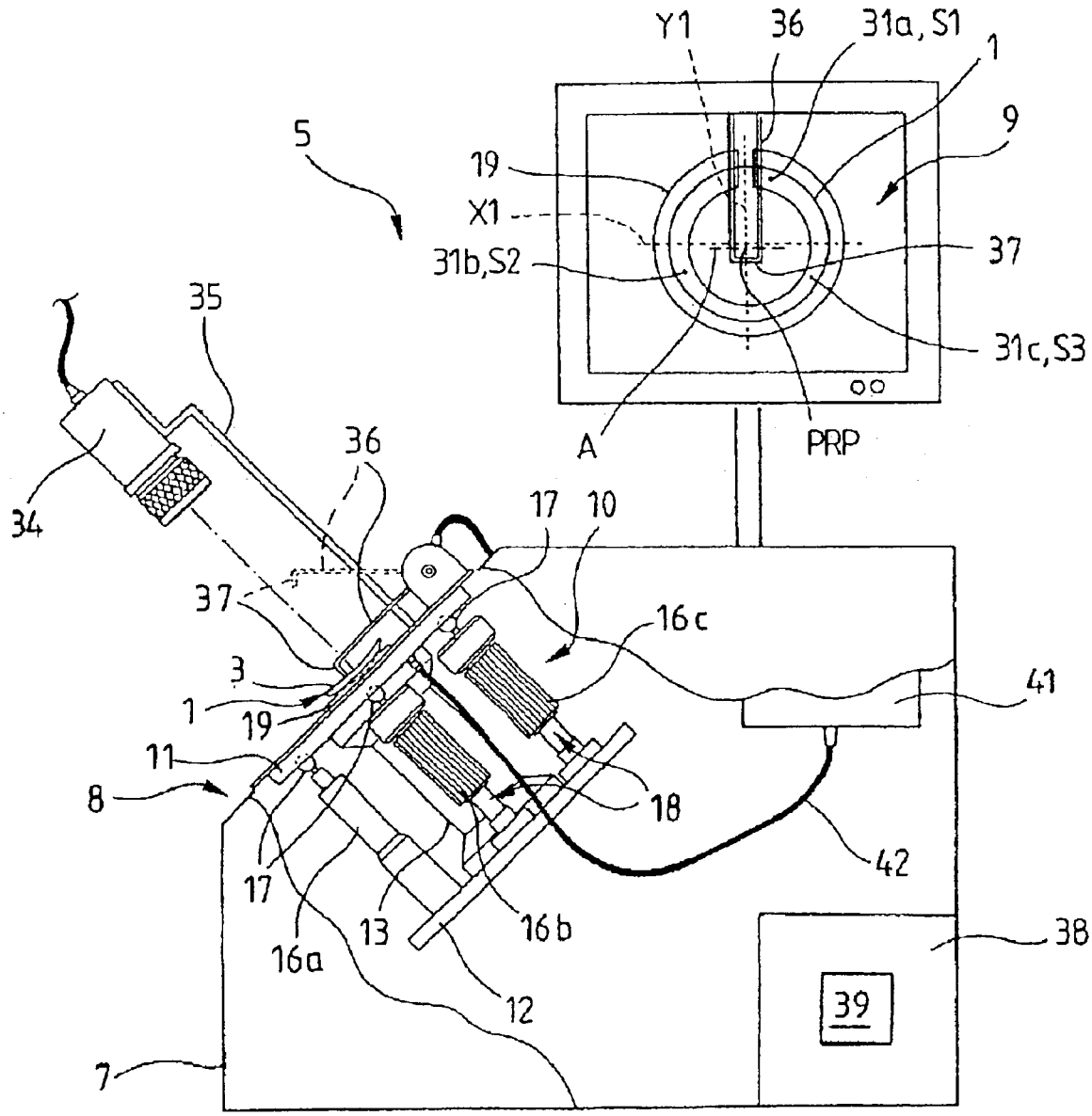
FIG. 1 is a partly cutaway side elevation view of apparatus according to the invention for fitting a holding block to a semifinished ophthalmic lens blank.

FIG. 1 shows blocking apparatus 5 for fixing to the blank 1 a holding block 6 intended to be attached to the spindle of a finishing machine (not shown) for surfacing the untreated face 3.

The front face 2 can have any three-dimensional shape (spherical, aspherical, toric, atoric, etc.), but this example relates to a progressively varying curvature for producing a progressive lens, because of its complexity.

Figure 2:
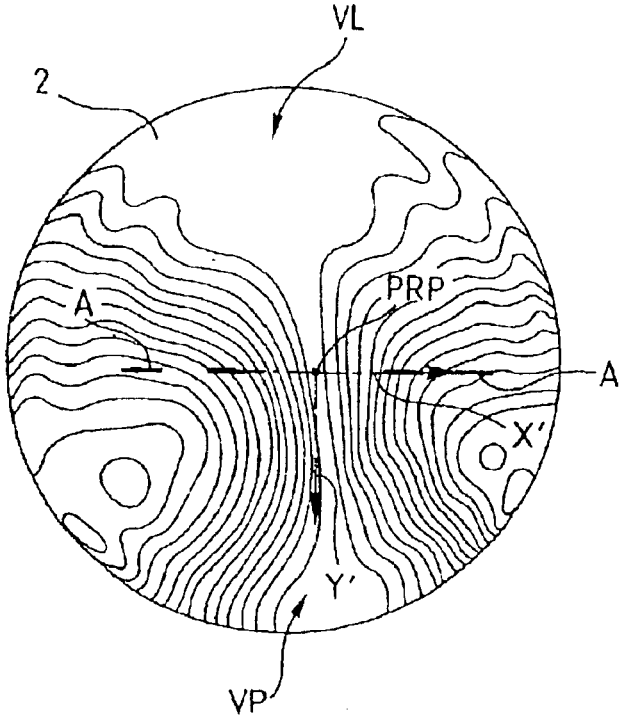
FIG. 2 is a front view of a finished face with progressively varying curvature of a semifinished ophthalmic lens blank on which isohypse lines are drawn.

The front face 2 has a distant vision area VL and a diametrically opposite near vision area VP. As shown in FIG. 2, the near vision area VP is not vertically aligned with the distant vision area VL in the horizontal bearing position, but slightly offset relative to that vertical alignment, the blank 1 here being intended for a right eye.

To give an idea of the three-dimensional shape of the front face 2 of the blank 1, isohypse lines have been drawn in FIG. 2 in the areas of the front face 2 on either side of a distant vision area VL/near vision area VP axis.

The front face 2 carries two location marks, namely a dot corresponding to the PRP of the blank, through which its optical axis passes, and on either side of the PRP a succession of aligned lines forming a location axis A corresponding to the horizontal nose-ears axis in the normal position when worn by the user.

As explained hereinafter, these marks are intended for respectively centering and angularly orienting the blank 1 when positioning it on the blocking apparatus 5.

As shown in FIG. 1, the blocking apparatus 5 includes a frame 7 defining an inclined console 8 above which is a display screen 9.

The apparatus 5 further includes a positioning device 10 inside the frame 7 and including two spaced and substantially circular parallel plates, namely an upper plate 11 fixed to the console 8 and a floating lower plate 12 carrying a sheath 13 into which is introduced a support shaft 14 having an upper end that forms a housing 15 intended to receive the holding block 6.

A lower end of the sheath 13 is rigidly fixed to the lower plate 12. The sheath is connected to the upper plate 11 by a ball-joint (not shown).

Moreover, the lower plate 12 is connected to the upper plate 11 by three parallel rods 16*a*, 16*b*, 16*c*, each of which is rigidly fixed to the lower plate 12 and connected to the upper plate 11 by a ball-joint 17.

One rod 16*a* is of fixed length and the other two rods 16*b* and 16*c* can have their length varied by a motorized screw/nut adjustment system 18.

For more details on the construction of the positioning device 10 see U.S. Pat. No. 4,372,368 in the name of the applicant.

Clearly, thanks to the rods 16*a*, 16*b*, 16*c*, it is possible to orient with respect to three perpendicular axes the support shaft 14, and consequently the holding block 6, relative to the upper plate 11.

A base 19 for positioning the semifinished blank 1 on the blocking apparatus 5 is fixed to the upper plate 11 on the axis of the sheath 13.

Figure 3A:
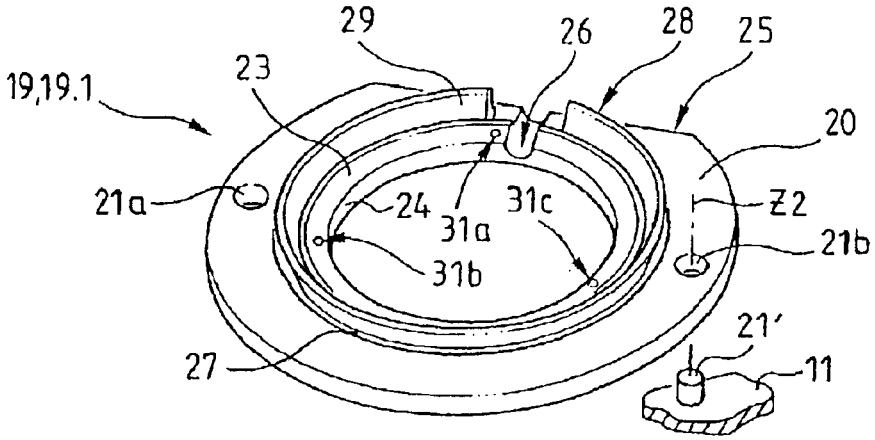
FIG. 3*a* is a perspective view of a bearing ring according to a first embodiment, adapted to receive a semifinished ophthalmic lens blank for the left eye of a user.
Figure 3B:
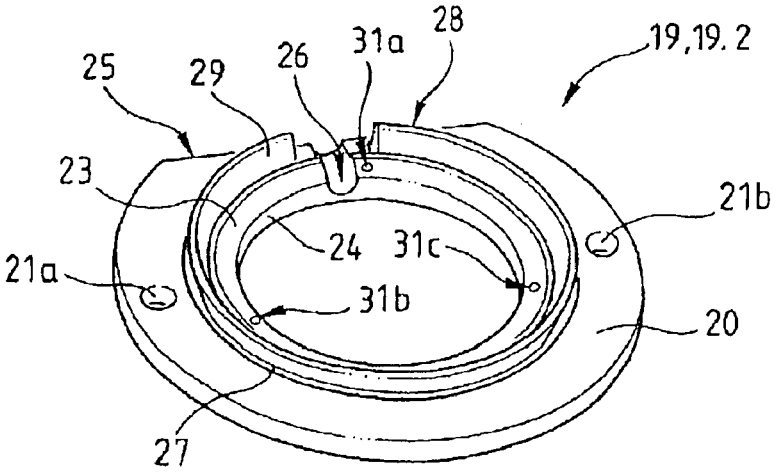
FIG. 3*b* is a view analogous to FIG. 3*a*, in a different viewing direction, of a bearing ring according to a first embodiment, adapted, by contrast, to receive a semifinished ophthalmic lens blank for the right eye of a user.
Figure 4:
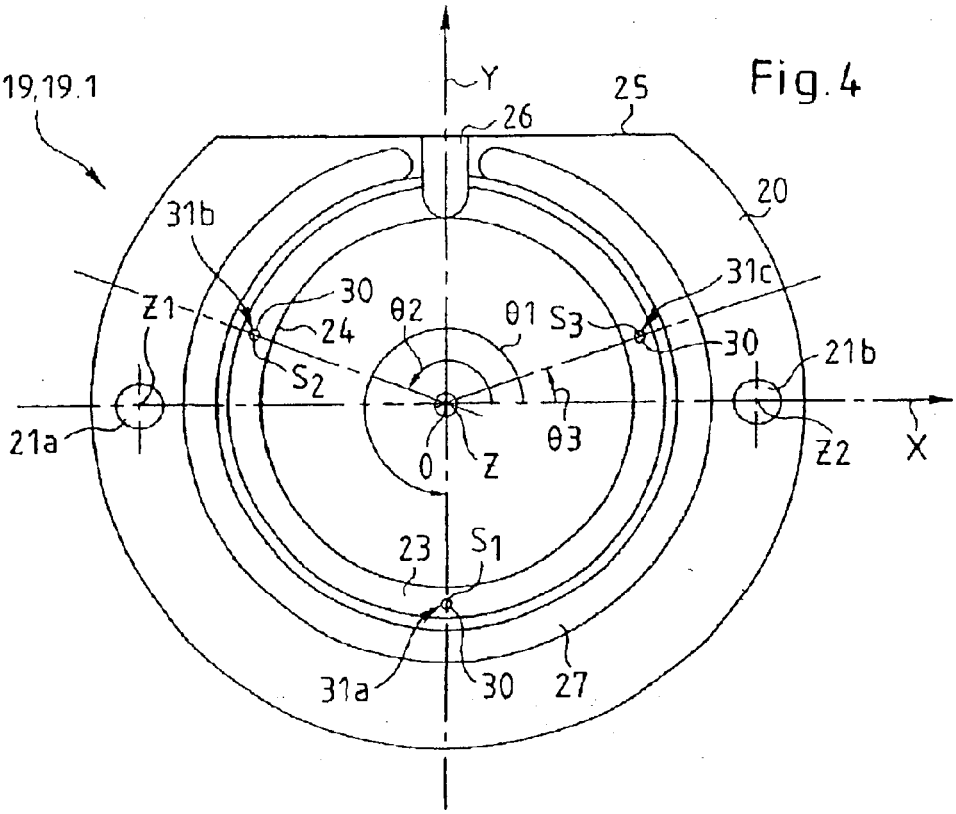
FIG. 4 is a top plan view of a bearing ring according to a second embodiment, adapted to receive equally a semifinished blank for the left eye or the right eye of a user.
Figure 5:
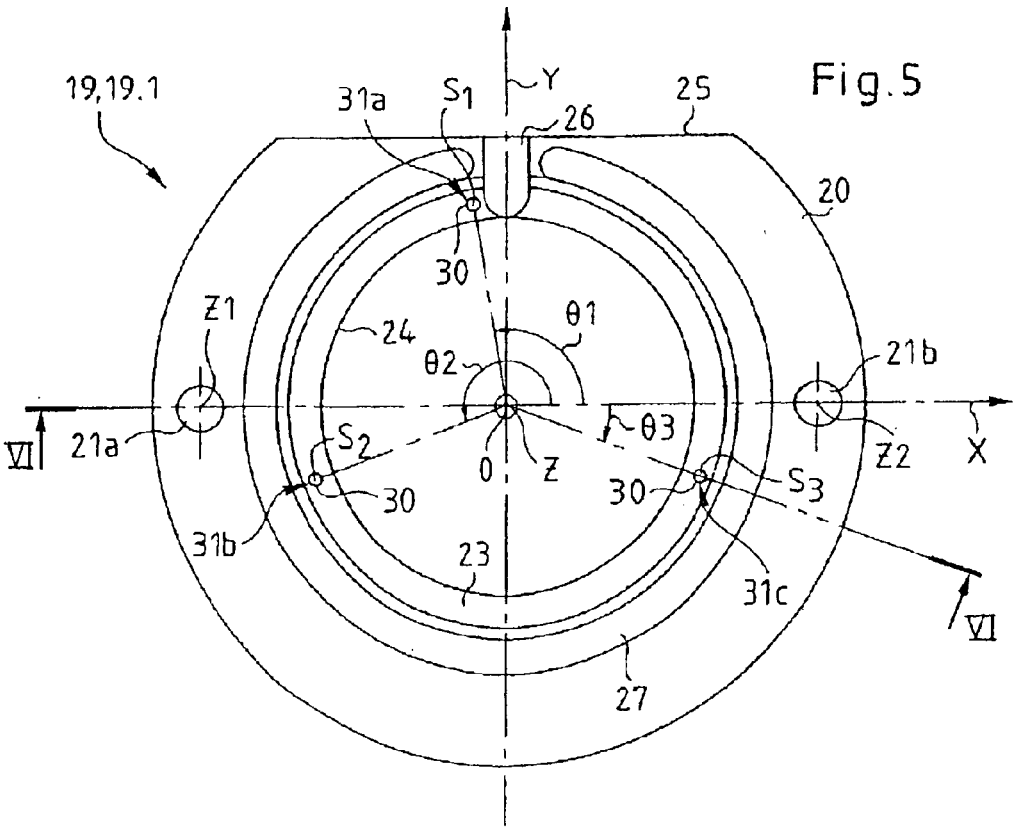
FIG. 5 is a top plan view of the bearing ring of FIG. 3*a;*
Figure 8:
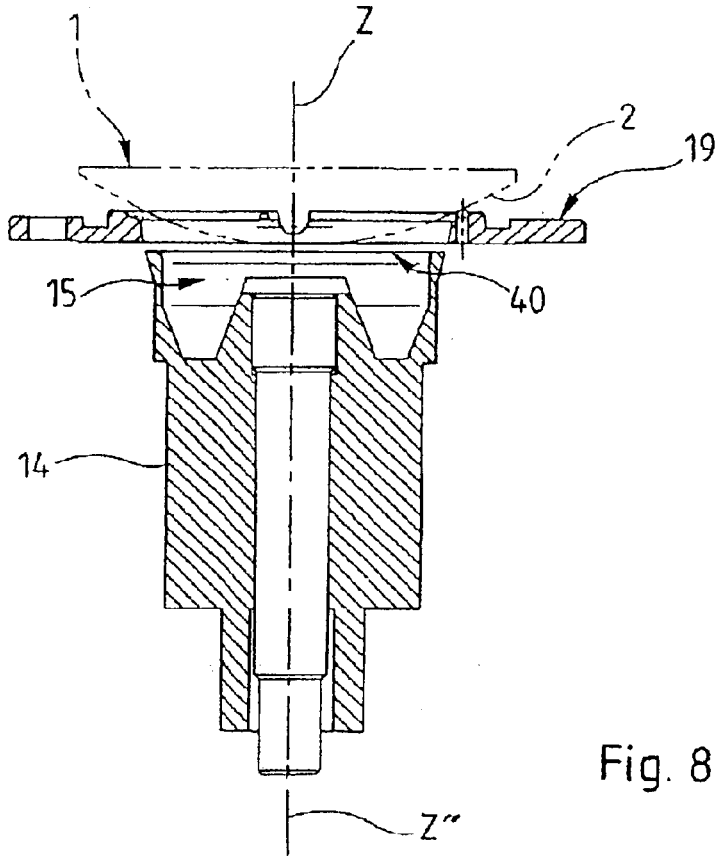
FIG. 8 is a sectional view in elevation showing a bearing ring according to the invention on which are positioned a semifinished ophthalmic lens blank shown in chain-dotted outline and a mobile shaft for positioning the holding block relative to the lens, in a position in which the ring and the shaft are coaxial.
Figure 9:
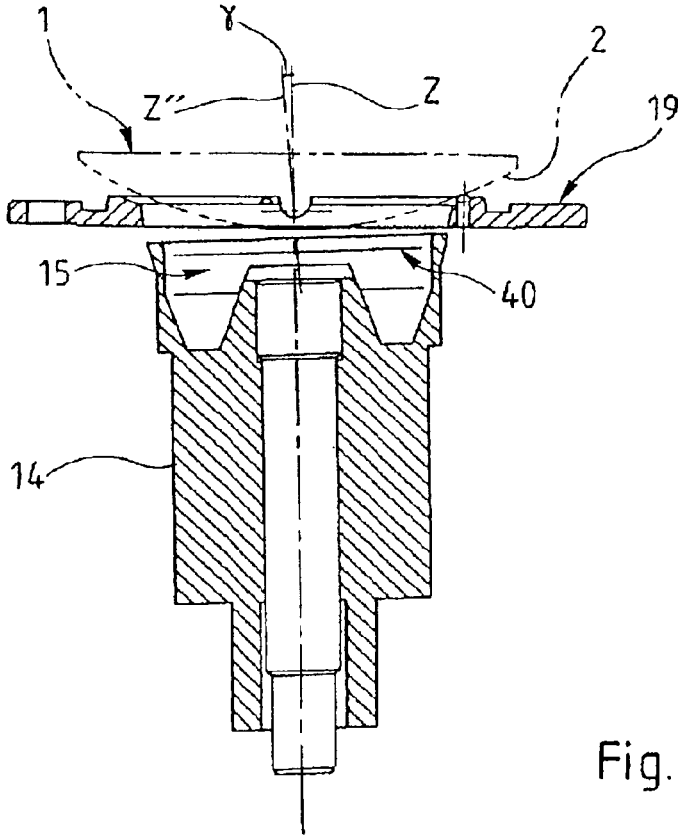
FIG. 9 is a view analogous to FIG. 8 with the shaft out-of-line relative to the bearing ring.
Figure 10:
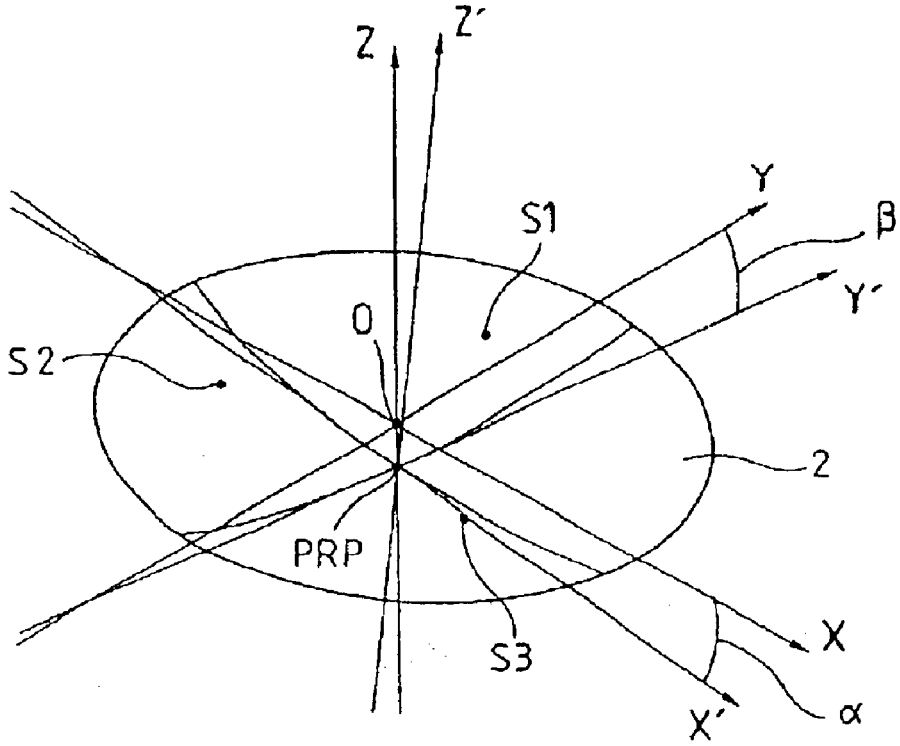
FIG. 10 is a simplified geometrical diagram showing the finished face of the semifinished blank bearing on the bearing points of a bearing ring according to the invention.
Figure 15:
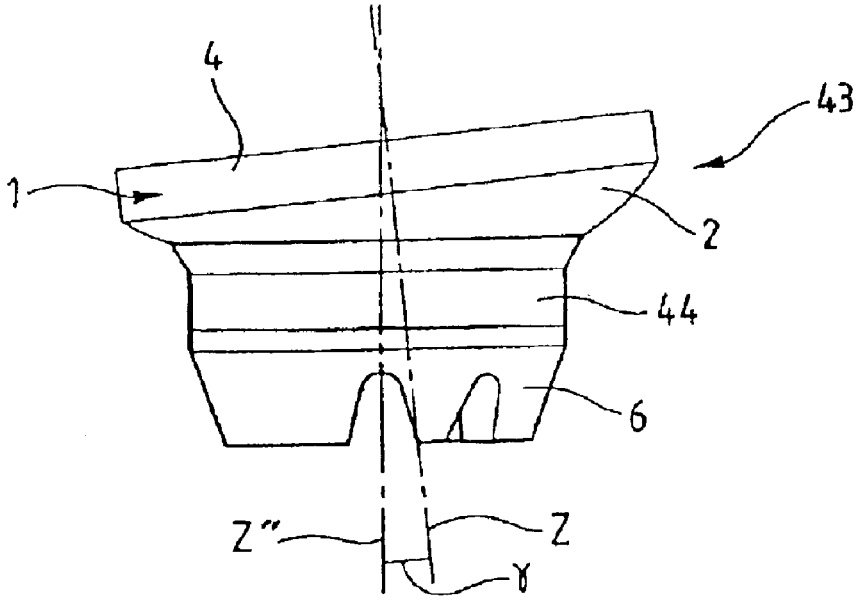
FIG. 15 is a perspective view showing a combination comprising a semifinished ophthalmic lens blank to which a holding block has been fitted by a method according to the invention.

As can be seen in FIGS. 3 to 5 in particular, this base 19 is an annular bearing ring having globally circular symmetry about an axis Z.

The ring 19 has an outer rim 20 which can be fixed to the upper plate 11. Two diametrically opposite holes 21*a*, 21*b* with axes Z1 and Z2 parallel to the axis Z are formed through the rim 20, and are adapted to locate over two pegs 21' provided on the plate 11 for accurately positioning and orienting the ring 19.

The ring 19 has a plane lower bearing face 22 by which it rests on the upper plate 11.

Inside the rim 20, on the side opposite the bearing face 22, the ring 19 has a seat 23 with a frustoconical surface and which is extended toward the center of the ring 19 by a bore 24. The seat 23 and the bore 24 are centered on the axis Z of the ring 19.

As can be seen in FIG. 5, the ring 19 is truncated and has a plane bearing face 25 parallel to a plane containing the axis Z of the ring and the axes Z1 and Z2 of the holes 21*a* and 21*b*.

An open channel 26 is also provided in the ring 19. This channel 26, which has a section substantially in the shape of a circular arc, extends in a radial direction perpendicular to the bearing face 25 and constitutes a recess occupying a portion of the thickness of the ring 19, intersecting successively, in the direction from the exterior toward the interior, the ring 20 and the seat 23, and possibly the bore 24.

A groove 27 in the rim 20, concentric with, around and near the seat 23, is interrupted on either side of and near the channel 26.

A seal 28 with a frustoconical lip 29 projecting from the rim 20 is fixed into the groove 27 by overmolding, adhesive bonding or the like.

There are three circular section holes 30 with axes parallel to the axis Z in the seat 23. Into each of the holes 30 is force-fitted a respective peg 31*a*, 31*b*, 31*c* with a cylindrical body 32 that is extended by a spherical surface head 33 projecting from the seat 23 and having a respective summit $S_1$, $S_2$, $S_3$ at its upper end.

The diameter of the pegs 31*a*, 31*b*, 31*c* is very much less than the other dimensions of the ring 19, so that to a reasonable approximation each head 33 and its summit $S_1$, $S_2$, $S_3$ can be regarded as one and the same.

The pegs 31*a*, 31*b*, 31*c*, or to be more precise the respective summits $S_1$, $S_2$, $S_3$, conjointly form the vertices of a triangle whose circumscribed circle is centered on the axis Z of the ring 19.

A unique reference plane parallel to the lower bearing face 22 of the ring 19 and perpendicular to its axis Z passes through the three summits $S_1$, $S_2$, $S_3$.

Two perpendicular axes are defined in this reference plane, intersecting on the axis Z, namely an axis X passing through the axes Z1, Z2 of the holes 21*a*, 21*b* and an axis Y coincident with the axis of the passage 26.

There is therefore an orthogonal system of axes XYZ defined relative to the ring 19 and which, when the latter is fixed to the upper plate 11, is fixed relative to the blocking apparatus 5. 0 is the center of the fixed system of axes relative to which the positions of the blank 1 and of the holding block 6 are defined in the remainder of the description.

The blank 1 must be positioned very accurately on the blocking apparatus 5.

This is because the optical properties of the finished lens are required to correspond very exactly to the prescription of the ophthalmologist.

In particular, the prism and axis adjustments for the front face 2 and the rear face 3 must correspond very accurately to the respective prism and axis adjustments defined by the prescription.

To this end, the blank 1 is positioned on the bearing ring 19:

in a centered manner, i.e. so that the PRP is on the axis Z of the ring 19, in an angularly defined manner, so that the location axis A lies in the plane XOZ formed by the axes X and Z, and so that the finished face 2 bears simultaneously on the three pegs 31*a*, 31*b*, 31*c* and the points of contact at which the finished face 2 bears on the pegs 31*a*, 31*b*, 31*c* are practically coincident with their respective summits $S_1$, $S_2$, $S_3$.

To facilitate positioning of the blank 1 by an operator, the apparatus 5 includes a video camera 34 carried by a boom 35 fixed to the console 8 so that the camera 34 is vertically aligned with and on the axis Z of the bearing ring 19. The image of the ring 19 formed by the camera 34 is displayed on the screen 9.

As can be seen in FIG. 1, the screen 9 also displays an orthogonal system of axes formed of two perpendicular axes shown in chain-dotted line, namely a horizontal axis X1 on the screen 9 representing the axis X of the fixed system of axes XYZ and a vertical axis Y1 on the screen 9 representing the axis Y thereof.

Accordingly, to position the blank 1 correctly on the bearing ring 19, as defined above, it is sufficient for the operator to check that on the image on the display screen 9 the PRP coincides with the crossing point of the axes X1 and Y1 and that the location axis A coincides with the axis X1.

The blocking apparatus 5 further includes a holding arm 36 which has a curved free end 37 and is articulated to the frame 7 to move between an open position in which its free end 37 is at a distance from the bearing ring 19 (as shown in chain-dotted outline in FIG. 1) and a closed position in which its free end 37 bears against the untreated face 4 of the blank 1, pressing the latter against the bearing ring 19 (as shown in full line in FIG. 1).

When the blank 1 has been positioned on the bearing ring 19, the operator makes the retaining arm 36 swing toward its closed position in order to preserve the position of the blank 1 during subsequent operations for fixing the holding block 6 to the finished face 2.

As explained below, these operations include orienting the holding block 6 and casting a low melting point metal between the holding block 6 and the finished face 2 of the blank 1.

These operations are coordinated by a control unit 38 including a calculator 39 into which the prescription prism and/or axis adjustments that the orientation of the holding block 6 must take into account are entered.

Given the progressively varying curvature of the finished face 2, when the blank 1 is positioned on the bearing ring 19, the summits $S_1$, $S_2$, $S_3$ forming the bearing points of the blank 1 are not on the same isohypse line, which causes tilting of the blank 1 and the subsequent appearance of a positioning prism, which is defined hereinafter, and whose value, expressed in diopters, depends on the three-dimensional shape of the finished face 2 and the position of the bearing points $S_1$, $S_2$, $S_3$.

As explained below, the definition of the orientation of the holding block 6 takes very accurate account of the positioning prism in order to compensate it when actually positioning the holding block 6, so that the final prism for the finished lens is actually equal to the prescription prism (even, and especially, if the prescription prism is zero).

To this end, a local orthogonal system of axes X'Y'Z' tied to the blank 1 is defined, whose axis Z' coincides with the optical axis of the blank 1 and whose axes X' and Y' respectively correspond to the projection of the location axis A and the vertical meridian passing through the PRP in the normal wearing position onto the plane tangential to the finished face at the PRP.

When the blank has been positioned:

the PRP, which is by definition the center of the system of axes X'Y'Z', is on the axis Z of the ring 19, which corresponds to centering of the blank 1 on the ring 19, the axis X' is in the plane XOZ formed by the axes X and Z and inclined in that plane relative to the axis X, and the axis Y' is in the plane YOZ formed by the axes Y and Z and inclined in that plane to the axis Y, which is the result of the chosen angular orientation of the blank 1 on the ring 19.

The angle between the axes X and X' in the plane XOZ is $\alpha$ and the angle between the axes Y and Y' in the plane YOZ is $\beta$. The angles $\alpha$ and $\beta$ define the orientation of the finished face 2 relative to the fixed system of axes XYZ and are characteristic of the positioning prism explained above.

An iterative calculation is used to obtain the values of the angles $\alpha$ and $\beta$ from the three-dimensional shape of the finished face 2 and the position of the bearing points $S_1$, $S_2$, $S_3$, as described below.

By convention, x, y and z are the cartesian coordinates (abscissa, ordinate, depth) of any point in space in the fixed system of axes XYZ and x', y' and z' are its cartesian coordinates in the tied system of axes X'Y'Z'.

As previously mentioned, the bearing points $S_1$, $S_2$, $S_3$ are on a circle centered on the axis Z. Let R be the radius of that circle. The position of any point P in the fixed system of axes XYZ can be expressed in cylindrical coordinates $\rho,\theta,z$, where $\rho$ is the distance from the point to the center O and $\theta$ is the angle between the vector OP and the axis X.

Thus the cylindrical coordinates of the bearing points $S_1$, $S_2$, $S_3$ can be expressed as follows, where i=1 to 3:

$$\begin{pmatrix} \rho_i = R \\ \theta_i \\ 0 \end{pmatrix}$$

The cartesian coordinates of the bearing points $S_1$, $S_2$, $S_3$ are then deduced, for i=1 to 3:

$$\begin{pmatrix} x_i = \rho_i \cos(\theta_i) \\ y_i = \rho_i \sin(\theta_i) \\ 0 \end{pmatrix}$$

Moreover, in the tied system of axes X'Y'Z', the three-dimensional shape of the finished face 2 is known; it is defined by a particular function $f$ such that, for a point (x', y', z') on the finished face:

$$z' = f(x', y').$$

In the fixed system of axes XYZ, the three-dimensional shape of the finished face is defined by another function $f_p$ such that, for a point (x, y, z) on the finished face, and where p is the (integer) index of the iteration:

$$z = f_p(x, y).$$

A first step E1 of the calculation superposes the tied system of axes X'Y'Z' on the fixed system of axes XYZ. At the same time, the index p is assigned the value 1, meaning that this is the first iteration of the calculation.

Figure 11:
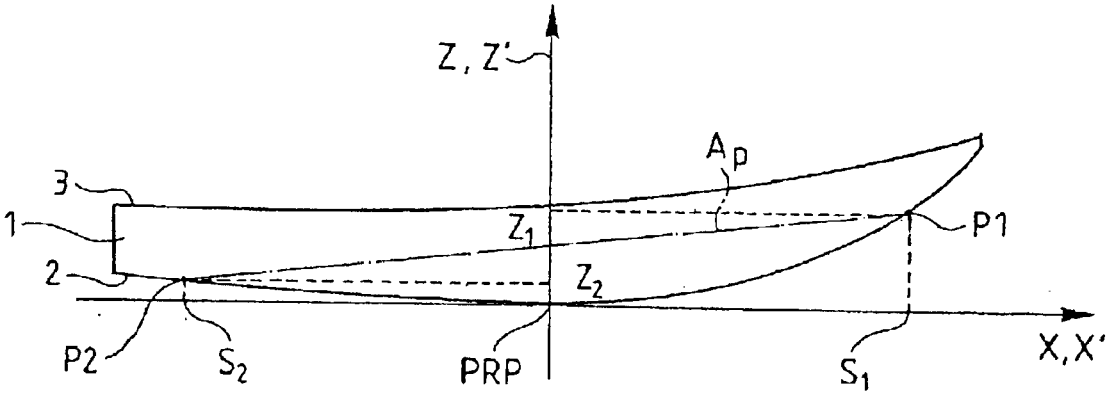
FIG. 11 is a simplified geometrical diagram representing the lens in section and two bearing points assumed to be diametrically opposed, illustrating one step in calculating the orientation of the blank.

This situation is shown in FIG. 11 where, for convenience, only two diametrically opposite bearing points $S_2$, $S_3$ are shown, both of which are on the axis X.

A second step E2 of the calculation defines the function $f_p$. For the first iteration (i=1), the fixed system of axes XYZ and the tied system of axes coinciding, the function $f_1$ is identical to the function $f$:$f_1=f$.

Let $S_1^P,S_2^P,S_3^P$ be the points on the finished face 2 obtained by projecting the bearing points $S_1$, $S_2$, $S_3$ onto the finished face 2 in a direction parallel to the axis Z. This projection preserves the abscissae and the ordinates, and the coordinates of the points $S_1^P,S_2^P,S_3^P$ are therefore as follows:

$$\begin{pmatrix} x_i \\ y_i \\ z_i = f_p(x_i, y_i) \end{pmatrix}$$

A third step E3 calculates the depths $z_i$, for i=1 to 3, of the points $S_1^P,S_2^P,S_3^P$.

A fourth step E4 calculates the maximum difference $\epsilon$ between the depths $z_i$ of the projected points using the following equation:

$$\epsilon=\max(|z_1-z_2|,|z_1-z_3|,|z_2-z_3|)$$

A fifth step E5 then compares the difference $\epsilon$ to a predetermined value $\epsilon_0$, for example equal to 1 micron.

The calculation continues as described above, for as long as $\epsilon>\epsilon_0$.

A single plane $A_p$ passes through the projected points $S_1^P,S_2^P,S_3^P$, whose equation in the fixed system of axes XYZ can be expressed as follows:

$$z=ax+by+c.$$

The coefficients a,b,c can be obtained by solving the following system of three linear equations in three unknowns:

$$f_p(x_i,y_i)=ax_i+by_i+c,\ i=1 \text{ to } 3.$$

This system is written as follows in matrix form:

$$\begin{bmatrix} x_1 & y_1 & 1 \\ x_2 & y_2 & 1 \\ x_3 & y_3 & 1 \end{bmatrix}\begin{bmatrix} a \\ b \\ c \end{bmatrix} = \begin{bmatrix} z_1 \\ z_2 \\ z_3 \end{bmatrix}$$

The coefficients a,b,c are obtained by inverting the previous system:

$$\begin{bmatrix} a \\ b \\ c \end{bmatrix} = \begin{bmatrix} x_1 & y_1 & 1 \\ x_2 & y_2 & 1 \\ x_3 & y_3 & 1 \end{bmatrix}^{-1}\begin{bmatrix} z_1 \\ z_2 \\ z_3 \end{bmatrix}$$

The intersection straight lines of the plane $A_p$ are at respective angles $\alpha_p$ and $\beta_p$ to the axes X and Y in the planes XOZ and YOZ. Since, by definition:

$$a=\tan(\alpha_p)$$

$$b=\tan(\beta_p)'$$

it can be deduced that:

$$\alpha_p=\text{Arctan}(a)$$

$$\beta_p=\text{Arctan}(b)$$

A sixth step E6 calculates the angles $\alpha_p$ and $\beta_p$ as described above.

A seventh step E7 tilts the tied system of axes X'Y'Z' (and consequently the finished face 2) relative to the fixed system of axes XYZ, so that the axis X' pivots through the angle $\alpha_p$ relative to the axis X in the plane XOZ and the axis Y' pivots through the angle $\beta_p$ relative to the axis Y in the plane YOZ. It is therefore a question of a combination of two rotations, whose respective matrices in the fixed system of axes are, by definition, as follows:

$$R1 = \begin{bmatrix} \cos\alpha_p & 0 & -\sin\alpha_p \\ 0 & 1 & 0 \\ \sin\alpha_p & 0 & \cos\alpha_p \end{bmatrix} \text{ and } R2 = \begin{bmatrix} 1 & 0 & 0 \\ 0 & \cos\beta_p & -\sin\beta_p \\ 0 & \sin\beta_p & \cos\beta_p \end{bmatrix}$$

The characteristic matrix R of the combined rotation is defined by the equation R=R1×R2.

Figure 12:
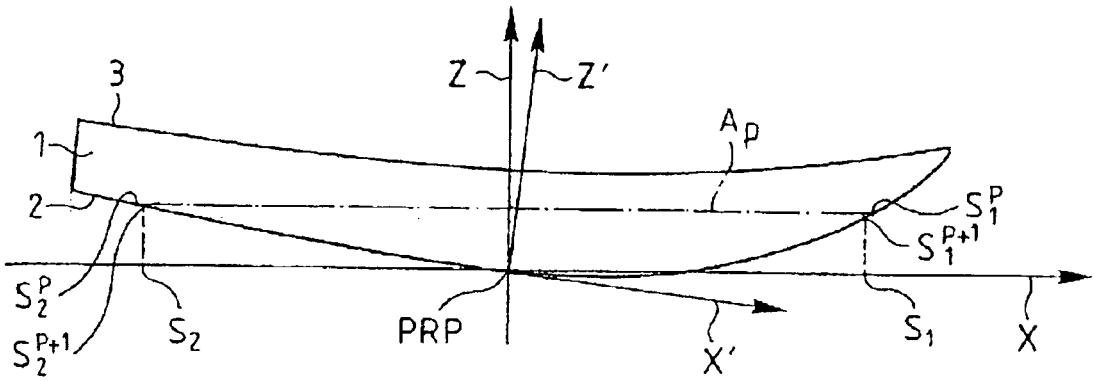
FIG. 12 is a diagram analogous to FIG. 11 showing the next step in calculating the orientation of the blank.

As a result of this combined rotation, the plane $A_p$ is parallel to the plane XOY in which the bearing points $S_1$, $S_2$, $S_3$ lie (FIG. 12).

However, given this tilting, the projections $S_1^P,S_2^P,S_3^P$ of the bearing points $S_1$, $S_2$, $S_3$ are no longer exactly in vertical alignment with the latter.

An eighth step E8 therefore increments the index p by one unit to start a new iteration: p becomes p+1.

In this new iteration, the new function $f_{p+1}$ defining the three-dimensional shape of the tilted finished face in the fixed system of axes XYZ is redefined by calculation. For this it is sufficient simply to change the axes for the matrix R.

All of the calculations described above are then repeated using the new function $f_{p+1}$.

As many iterations are effected as necessary, i.e. the steps E2 to E8 are repeated until the value of the difference $\epsilon$ obtained in step E4 is found to be less than the predetermined value $\epsilon_o$ in step E5. Let N denote the corresponding iteration index.

As soon as $\epsilon<\epsilon_0$, the orientation of the finished face 2 is considered to correspond to its orientation when it is positioned on the bearing ring 19. According to this approximation, the single plane $A_N$ passing through the projections $S_1^P,S_2^P,S_3^P$ is declared to be parallel to the plane XOZ passing through the bearing points $S_1$, $S_2$, $S_3$.

In the final analysis, the tied system of axes X'Y'Z' has been tilted through the angles $\alpha$ et $\beta$, respectively equal to the sum of the successive tilt angles $\alpha_p$ and $\beta_p$, that is to say:

$$\alpha = \sum_{p=1}^{p=N} \alpha_p \quad \beta = \sum_{p=1}^{p=N} \beta_p.$$

Thus a geometrical definition of the positioning prism is available. However, the prescribed prism being expressed in diopters, the values of the angles $\alpha$ and $\beta$ cannot be used directly.

To this end, the positioning prism can be defined by two prismatic deviations PrH and PrV in the planes XOZ and YOZ, respectively.

The prismatic deviations PrH and PrV are defined as follows:

$$PrH=100\times\tan((n-1)\times AngH) \quad (1)$$

$$PrV=100\times\tan((n-1)\times AngV) \quad (2)$$

where n is the refractive index of the material from which the blank is made and AngH and AngV are the angles to the axes X and Y of the projections of the normal to the finished face to the PRP onto the planes XOZ and YOZ, respectively.

Mathematically, the angles AngH and AngV are defined as follows:

$$AngH = \text{Arctan}\left(\frac{\left(\frac{\partial f_N}{\partial x}\right)_{x=0,y=0}}{L}\right)$$

$$AngV = \text{Arctan}\left(\frac{\left(\frac{\partial f_N}{\partial y}\right)_{x=0,y=0}}{L}\right)$$

where:

$$L = \sqrt{1 + \left(\frac{\partial f_N}{\partial x}\right)^2_{x=0,y=0} + \left(\frac{\partial f_N}{\partial y}\right)^2_{x=0,y=0}}$$

where:

It will have been understood that $$\left(\frac{\partial f_N}{\partial x}\right)_{x=0,y=0}$$

and $$\left(\frac{\partial f_N}{\partial y}\right)_{x=0,y=0}$$

are the partial derivatives at the PRP of the function $f_N$ defining the finished face 2 in the last iteration.

A ninth step E9 calculates the angles AngH and AngV of the positioning prism.

The prescription prism is defined by the prismatic deviations $PrH_0$ and $PrV_0$ defined as follows:

$$PrH_0=0$$

$$PrV_0=K\times\text{add}$$

in which add is the power addition of the ophthalmic lens that it is required to obtain and K is an index of proportionality, generally equal to $$\frac{2}{3}.$$

Using equations (1) and (2) above, it is possible to characterize the prescription prism by the angles $AngH_0$ and $AngV_0$ defined as follows:

$$AngH_0=0$$

$$AngV_0 = \frac{\text{Arctan}\left(\frac{PrV_0}{100}\right)}{n-1}$$

The geometrical angular difference between the prescription prism and the positioning prism can be deduced from the above considerations.

This angular difference is defined by two angles γ and ϕ defined as follows:

$$\gamma = \text{Arccos}\left(\tan(AngV)\times\sin(AngV_0) + \frac{\cos(AngV_0)}{\sqrt{1+\tan^2(AngH)+\tan^2(AngV)}}\right)$$

-continued $$\phi = \text{Arctan}\left(\frac{\sin(AngV - AngV_0)}{\sin(AngH)}\right)$$

The angles γ and ϕ define, in the fixed system of axes XYZ, the orientation of the support shaft 14 (or, which amounts to the same thing, the orientation of the holding block 6), enabling the positioning prism to be compensated, γ being defined as the angle between the axis Z" of the support shaft 14 and the axis Z and γ being defined as the angle to the axis X of the projection of the axis Z" of the support shaft 14 onto the plane XOY.

A tenth step E10 calculates the angles γ and ϕ.

Figure 14:
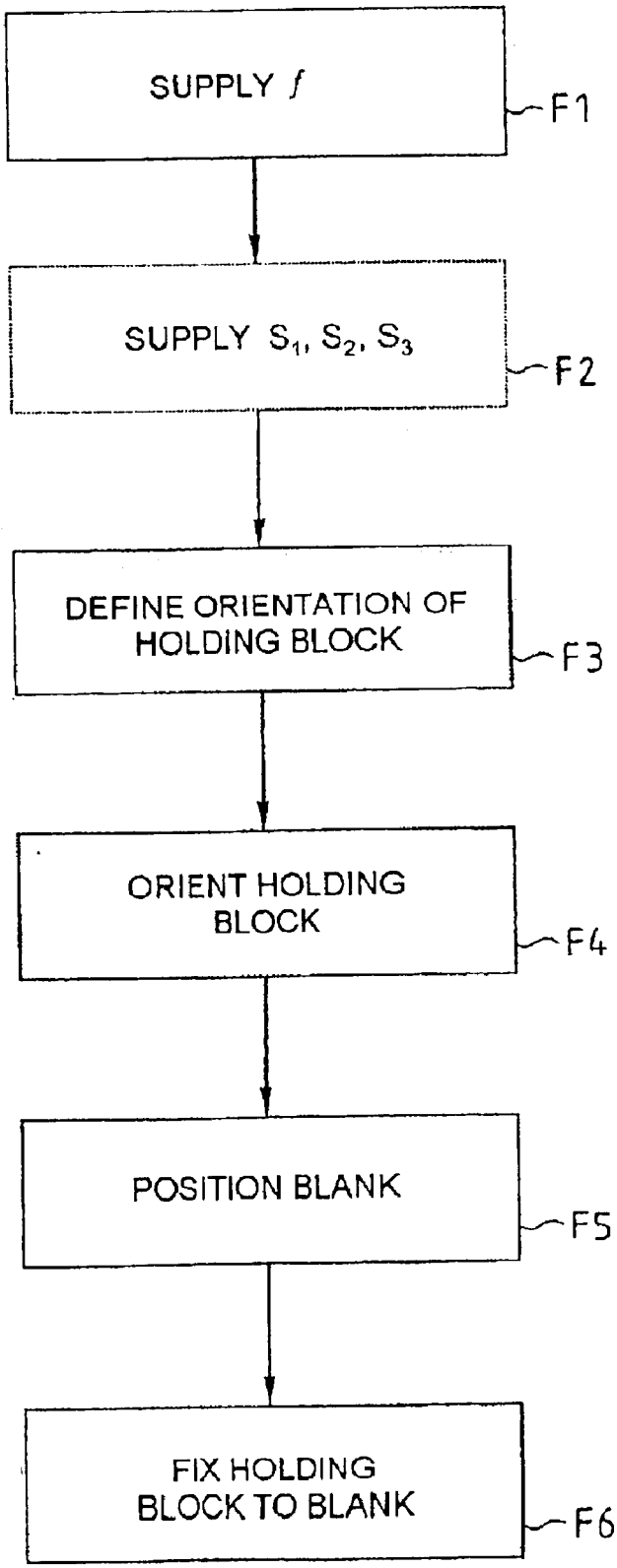

Steps E1 to E10 described above for defining the orientation of the holding block 6, which are combined in the FIG. 14 diagram, can be programmed in the form of a calculation algorithm in the calculator 39 of the control unit 38.

Before describing in its entirety the method used to place the holding block 6 on the blank 1, there follow a few additional details concerning the production of the bearing ring 19.

On the console 8, the ring 19 is positioned so that the axis X is horizontal with the bearing face 25 oriented upward.

In a first embodiment, shown in FIGS. 3*a* and 3*b*, there are two bearing rings 19.1 and 19.2, according to whether a holding block 6 is to be placed on a blank for a left eye or on a blank for a right eye. The rings 19.1, 19.2 are distinguished from each other by the location of their pegs 31*a*, 31*b*, 31*c*.

Except for the seal 28, each of the rings 19.1, 19.2 is made entirely of steel. The pegs 31*a*, 31*b*, 31*c* are preferably made of hardened steel.

Each head 33 has a diameter from 1.5 to 3 mm. In practice, this diameter is preferably 2 mm.

The diameter of the heads 33 is very much less than the mean radius of curvature of the finished face 2, which is generally from 100 to 150 mm, which justifies the above approximation whereby the bearing points of the finished face 2 against the pegs 31*a*, 31*b*, 31*c* are considered to be more or less coincident with the summits $S_1$, $S_2$, $S_3$.

The diameter of the edge 4 of a semifinished ophthalmic lens blank is conventionally 65 mm.

The diameter of the circumscribed circle of the triangle defined by the summits $S_1$, $S_2$, $S_3$ of the pegs 31*a*, 31*b*, 31*c* is therefore made less than 65 mm, for example from 50 to 60 mm.

The diameter of the circumscribed circle is preferably equal to 55 mm, which is sufficiently large, relative to the diameter of the blank 1, to guarantee perfect stability of the latter, but also sufficiently small to eliminate the effects of variations in the depth of the PRP on moving from one blank to another.

Because of this, the depth of the PRP, that is to say, in practice, its distance from the support shaft 14, remains more or less constant from one blank to another; in any event, it remains within a range of values for which it is sure that the blank will not strike the support 14, and for which the fixing of the support shaft 14 to the blank will be sufficiently rigid to absorb the motor torque and the machining torque when finishing the untreated face 3.

Of the bearing rings 19.1, 19.2, FIG. 3*a* shows the ring 19.1 for positioning a blank 1 intended for a left eye.

As mentioned above in the description of calculating the orientation of the holding block 6, the location of the summits $S_1$, $S_2$, $S_3$ on the ring 19 can be defined, relative to the fixed system of axes, by their cylindrical coordinates.

Their depth being zero, since by virtue of the definition of the fixed system of axes the summits are in the plane XOY, their coordinates are reduced to $\rho_i$ and $\theta_i$, for i=1 to 3.

Whatever the value of i, $\rho_i$ is equal to the radius of the circumscribed circle for the triangle formed by the summits, a range of values for which is given above. Accordingly, regardless of the value of i, $\rho_i$ is from 25 to 30 mm and preferably equal to 22.5 mm.

The first peg 31*a* is in the angular vicinity of the channel and the second peg 31*b* and the third peg 31*c* have a relatively large angular spacing from it, although they are not diametrally opposed to it.

Moreover, their location is such that the angle between any two of the pegs 31*a*, 31*b*, 31*c* is always greater than 90°.

Thus the angular coordinate $\theta_1$ of the first summit $S_1$ is from 95° to 105° and preferably equal to 100°. In other words, the angle between the vector $OS_1$ and the axis Y is from 5° to 15° and preferably equal to 10° (FIG. 5).

The angular coordinate $\theta_2$ of the second summit $S_2$ is from 195° to 205° and preferably equal to 200°. In other words, the angle between the vector $OS_2$ and the axis X is from 15° to 25° and preferably equal to 20° (FIG. 5).

Finally, the angular coordinate $\theta_3$ of the third summit $S_3$, the absolute value of which is equal to the angle between the vector $OS_3$ and the axis X, is from −15° to −25° and preferably equal to −20° (FIG. 5).

This means that the angles at the summits of the triangle $S_1S_2S_3$, i.e. the angles ($S_1S_2$, $S_1S_3$), ($S_2S_1$, $S_2S_3$) ($S_3S_2$, $S_3S_1$), are respectively from 60° to 80°, from 50° to 70°, and from 40° to 60°.

From the point of view of the operator, when the ring 19.1 is positioned on the console 8, which corresponds to the orientation shown in FIG. 5, the first peg 31*a* is to the left of the channel 26.

FIG. 4 shows the other bearing ring 19.2, for positioning a blank intended for a right eye.

The ring 19.2 can be deduced from the ring 19.1 just described by consideration of plane symmetry with respect to the plane YOZ.

Accordingly, compared to the previous ring 19.1, only the angular coordinate $\theta_1$, of the first summit $S_1$ changes, and here is between 75° and 85° and preferably equal to 80°. The angle between the vector $OS_1$ and the axis Y is still from 5° to 15° and preferably equal to 10°.

From the point of view of the operator, when the ring 19.2 is positioned on the console 8, the first peg 19*a* is to the right of the channel 26.

In a second embodiment, a single ring 19.3 shown in FIG. 4 is equally adapted to receive a blank for a left eye or a blank for a right eye.

The ring 19.3 has all of the features of the rings 19.1 and 19.2 described above, except for the positions of the summits $S_1$, $S_2$, $S_3$, i.e. of the pegs 31*a*, 31*b*, 31*c*. Their common elements carry the same reference numbers, of course.

Here the first peg 31*a* is diametrically opposite channel 26 and therefore on its axis. Because of this, the summit $S_1$ is on the axis Y, as shown in FIG. 4.

Thus the angular coordinate $\theta_1$ of the first summit $S_1$ is equal or substantially equal to 270°. The summits $S_2$ and $S_3$, i.e. the two pegs 31*b* and 31*c*, are on the opposite side of the axis X to the first peg 31*a*.

In other words, the angle between the vector $OS_1$ and the axis Y is zero or virtually zero (i.e. less than 5°).

The angular coordinates $\theta_2$, $\theta_3$ are preferably equal to 160° and 20°, respectively, but they can be from 155° to 165°, and from 15° to 25°, respectively.

In other words, the angle between the vector $OS_2$ and the axis X is from −15° to −25° and is preferably equal to −20° and the angle between the vector $OS_3$ and the axis X is from 15° to 25° and is preferably equal to 20°.

Whichever ring 19.1, 19.2, 19.3 is used, when a blank 1 is positioned correctly on the ring, the summit $S_1$ of the first peg 31*a* comes into contact with a point on the finished face 2 in the near vision area VP and the summits $S_2$ and $S_3$ of the second and third pegs 31*b*, 31*c* come into contact with points on the finished face 2 each of which is in a transition area between the distant vision area VL and the near vision area VP, but closer to the distant vision area VL.

To place the holding block 6 on a semifinished blank 1, the following procedure is used. It is assumed that a holding block 6 is correctly placed in the housing 15 of the support shaft 14 and that the bearing ring 19, chosen according to the type of blank (left or right eye) to which the holding block 6 is to be fitted, is correctly positioned and fixed to the upper plate 11.

A first operation F1 enters in the calculator 39 the predetermined function *f* defining the three-dimensional shape of the finished face 2 of the blank 1.

Figure 13:
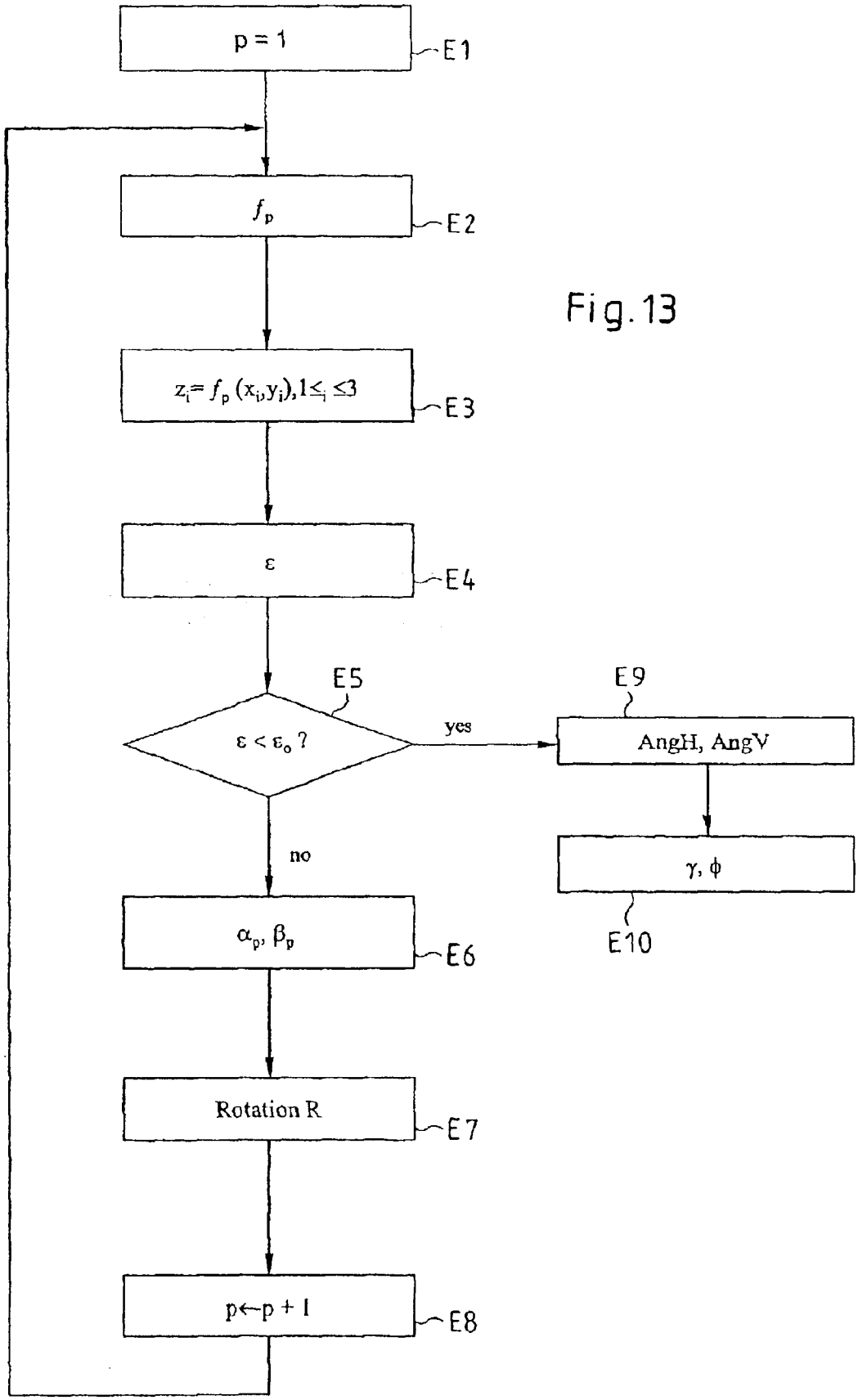
FIGS. 13 and 14 are diagrams illustrating the different steps of a method according to the invention.

A second operation F2 enters into the control unit 38, i.e. into its calculator 39, the cylindrical or cartesian coordinates of the summits $S_1$, $S_2$, $S_3$. This is optional at this stage, in that these coordinates might well have been stored beforehand to enable them to be used again. The FIG. 13 diagram allows for this possibility.

A third operation F3 defines the orientation of the support shaft 14. This operation is carried out by the calculator 39 using the method described above comprising the ten steps E1 to E10.

A fourth operation F4 positions the support shaft 14 in the orientation defined above during the third operation F3. This is controlled by the control unit 39.

A fifth operation F5 positions and fixes the blank 1 on the bearing ring 19 in conformance with the centering and the angular orientation defined above.

The blank 1 is held onto the bearing ring 19 by the retaining arm 36. In this position, the finished face 2 is in contact with the lip 29 of the seal 28, as shown in FIG. 7, so that a seal is formed between the seal 28 and the finished face 2, except at the location of the channel 26, of course.

A molding cavity delimited by the finished face 2, the lip 29 of the seal 28, the seat 23, the bore 24 and the holding block 6 is therefore defined between the finished face 2 and the facing holding block 6.

A sixth operation F6 fixes the holding block 6 to the finished face 2 of the blank 1.

In this operation a low melting point metal is poured into the cavity 40 via the channel 26. Because the channel 26 lies over the cavity 40, as a result of the orientation of the bearing ring 19 and the inclination of the console 8, this is facilitated by gravity.

To this end, the apparatus includes a reservoir 41 connected to the cavity 40 by a hose 42. The control unit 39 controls the supply of metal to the cavity 40 from the reservoir 41.

The metal is then cooled. It can instead be allowed to cool naturally, although this takes longer.

The order of the operations F1 to F6 as described above is indicative. Some of the operations can be shifted. In particular, the operation F5 of positioning the blank 1 can be done first.

After moving the retaining arm 36 to its open position, all that remains is to remove from the apparatus 5 the now rigid assembly 43 comprising the blank 1, the holding block 6 and the low melting point metal interface 44. To facilitate this removal, the bore 24 in the ring 19 can be slightly set back, as shown in FIG. 7.

Because of the channel 26 in the ring 19, a metal sprue remains on the assembly 43.

The fact that the ring 19 is truncated, as mentioned above, minimizes the length of the channel 26 and therefore the length of this sprue, and economizes on the low melting point metal, which is a costly consumable.

As the definition of the orientation of the holding block 6 takes account of the exact three dimensional shape of the finished face 2, it is clear that the same ring 19 is adapted to receive all of the range of semifinished blanks produced, regardless of the type of finished face.

Also, although the foregoing description applies to a finished face 2 of progressively varying curvature, the same ring 19 suits all other types of finished face, including spherical, aspherical, toric and atoric finished faces.

What is claimed is:

1. A method of fitting a holding block (6) to a semifinished ophthalmic lens blank (1) intended to have a predetermined prism, which method includes the following steps:

positioning the blank (1) on a fixed base (19), in a centered and angularly defined manner, so that the finished face (2) of the blank (1) bears conjointly on a plurality of bearing points ($S_1$, $S_2$, $S_3$) of said base (19), defining an orientation of the holding block (6) relative to the blank (1), orienting the holding block (6) in the defined manner, and fixing the holding block (6) to the finished face (2) while maintaining orientation, characterized in that the step of defining the orientation of the holding block (6) includes the following steps:

taking account of the three-dimensional shape of the finished face (2) and the position of said bearing points ($S_1$, $S_2$, $S_3$)

deducing therefrom the orientation of the finished face (2) when the blank (1) is positioned on the base (19), taking account of a predetermined prism, and deducing from the orientation of the finished face (2) and the predetermined prism the orientation of the holding block (6) relative to the finished face, characterized in that, to orient the finished face (2) when the blank (1) is positioned on the base (19), a positioning prism resulting from tilting of the blank (1) when it is placed on the base is calculated, and characterized in that, to define the orientation of the holding block (6), two angles $\gamma$ and $\phi$ are calculated defined by the following equations:

$$\gamma = \text{Arccos}\left(\tan(AngV)\times\sin(AngV_0) + \frac{\cos(AngV_0)}{\sqrt{1+\tan^2(AngH)+\tan^2(AngV)}}\right)$$

$$\phi = \text{Arctan}\left(\frac{\sin(AngV - AngV_0)}{\sin(AngH)}\right)$$

in which:

AngH and AngV are defined as follows:

$$AngH = \text{Arctan}\left(\frac{\left(\frac{\partial f_N}{\partial x}\right)_{x=0,y=0}}{L}\right)$$

$$AngV = \text{Arctan}\left(\frac{\left(\frac{\partial f_N}{\partial y}\right)_{x=0,y=0}}{L}\right)$$

where $f_N$ is a function of the type $z=f_N(x,y)$ defining the shape of the finished face (2) in a system of axes XYZ fixed relative to the base (19) and x,y,z are the cartesian coordinates linked respectively to the axes X, Y and Z of said fixed system of axes, L being defined by the following formula:

$$L = \sqrt{1+\left(\frac{\partial f_N}{\partial x}\right)^2_{x=0,y=0}+\left(\frac{\partial f_N}{\partial y}\right)^2_{x=0,y=0}}$$

$AngV_0$ is defined as follows:

$$AngV_0 = \frac{\text{Arctan}\left(\frac{PrV_0}{100}\right)}{n-1}$$

$PrV_0$ being defined as follows:

$$PrV_0 = K\times add$$

where add is the power addition of the ophthalmic lens to be obtained and K is an index of proportionality preferably equal $$\frac{2}{3}.$$

2. A method according to claim 1, characterized in that three bearing points ($S_1$, $S_2$, $S_3$) are provided on the base (19) and in that the function $f_N$ is obtained by repeating the following succession of steps:

calculating a function $f_p$ defining the three-dimensional shape of the finished face (2) in the fixed system of axes XYZ, calculating the depths $z_i$ tied to the axis Z of the fixed system of axes XYZ of the projections of the bearing points ($S_1$, $S_2$, $S_3$) onto the finished face (2) in the direction of the axis Z by means of the following formula: $z_i=f_p(x_i,y_i)$ where, for each bearing point ($S_i$), $x_i$ and $y_i$ are its coordinates respectively tied to the axis X and the axis Y of the fixed system of axes xyz, calculating the maximum difference $\epsilon$ between the depths $z_i$, comparing the difference $\epsilon$ with a predetermined value $\epsilon_o$, calculating the angles $\alpha_p$ and $\beta_p$ defined by the following equations:

$$\alpha_p = \text{Arc tan}(a)$$

$$\beta_p = \text{Arc tan}(b)$$

where a and b are the director coefficients of the plane $A_p$ passing through the projections of the bearing points ($S_1$, $S_2$, $S_3$) onto the finished face (2), tilting the finished face (2) through two rotations with a first rotation through an angle $\alpha_p$ in the plane X, Z and a second rotation through an angle $\beta_p$ in the plane Y, Z, incrementing p by one unit, for as long as the difference $\epsilon$ is greater than the predetermined value $\epsilon_o$, where:

i is an integer from 1 to 3, p is an integer initially equal to 1, with $$f_1 = f$$

where f is a predetermined function of the type $z'=f(x',y')$ defining the three-dimensional shape of the finished face (2) in an orthogonal system of axes X'Y'Z' tied to the finished face (2), x',y',z' being the cartesian coordinates respectively tied to the axes X', Y', Z' of the tied system of axes X'Y'Z', N is the value of p when the difference $\epsilon$ becomes less than the predetermined value $\epsilon_0$.

3. A method according to claim 2, characterized in that the difference s is defined as follows:

$$\epsilon=\max(|z_1-z_2|,|z_1-z_3|,|z_2-z_3|).$$

4. A method according to claim 2, characterized in that, the plane $A_p$ being defined in the fixed system of axes XYZ by the equation:

$$Z=ax+by+C,$$

the coefficients a and b are defined as follows:

$$\begin{bmatrix} a \\ b \\ c \end{bmatrix} = \begin{bmatrix} x_1 & y_1 & 1 \\ x_2 & y_2 & 1 \\ x_3 & y_3 & 1 \end{bmatrix}^{-1} \begin{bmatrix} z_1 \\ z_2 \\ z_3 \end{bmatrix}.$$

5. A method according to claim 1, characterized in that the holding block (6), which has an axis Z", is oriented so that:

the angle between its axis Z" and the axis Z of the fixed system of axes XYZ is equal to the angle $\gamma$, and the angle between the projection of its axis Z" in the plane formed by the axes X, Y of the fixed system of axes XYZ and the axis X of that fixed system of axes is equal to the angle $\phi$.

6. A method according to claim 1, characterized in that the holding block (6) is fixed to the finished face (2) by pouring a low melting point metal into a cavity (40) formed between the finished face (2) and the holding block (6) and cooling the metal or allowing it to cool.

7. A bearing ring for positioning a semifinished ophthalmic lens blank (1) on blocking apparatus (5) for the purpose of fitting to the finished face (2) of the blank (1) a holding block (6), the ring (19) including a plurality of bearing points ($S_1$, $S_2$, $S_3$) against which the finished face (2) of the blank (1) is adapted to press, characterized in that the bearing points ($S_1$, $S_2$, $S_3$) are each on a spherical surface (33) whose diameter is small compared to the radius of curvature of the finished face (2) of the blank (1).

8. A ring according to claim 7, characterized in that the diameter of said spherical surface (33) is from 1.5 mm to 3 mm.

9. A ring according to claim 8, characterized in that the diameter of said spherical surface (33) is equal to 2 mm.

10. A ring according to claim 7, characterized in that each spherical surface (33) is part of a projecting peg (31*a*, 31*b*, 31*c*).

11. A ring according to claim 10, characterized in that the peg (31*a*, 31*b*, 31*c*) is an add-on.

12. A ring according to claim 10, characterized in that it includes three pegs (31*a*, 31*b*, 31*c*).

13. A ring according to claim 12, characterized in that the ring is globally circularly symmetrical about an axis Z and the summits of the pegs are in a common plane perpendicular to the axis Z.

14. A ring according to claim 13, characterized in that the pegs are at the vertices of a triangle whose circumscribed circle is centered on the axis Z.

15. A ring according to claim 14, characterized in that said circumscribed circle has a diameter from 50 to 60 mm.

16. A ring according to claim 15, characterized in that said circumscribed circle has a diameter equal to 55 mm.

17. A ring according to claim 14, characterized in that the angles at the vertices of said triangle are respectively from 60° to 80°, from 50° to 70°, and from 40° to 60°.

18. A ring according to claim 12, characterized in that it has a recessed channel (26) extending along a radial axis.

19. A ring according to claim 18, characterized in that one of the pegs (31*a*) is near the channel (26).

20. A ring according to claim 18, characterized in that the peg (31*a*) near the channel (26) is offset angularly relative thereto by an angle from 5° to 15° and preferably equal to 10°.

21. A ring according to claim 18, characterized in that one of the pegs (31*a*) is diametrically opposite and on the axis of the passage (26).

* * * * *